United States Patent [19]

Pellerin

[11] Patent Number: 4,781,152

[45] Date of Patent: Nov. 1, 1988

[54] BARREL HEAT ENGINE WHOSE PISTONS AND LINERS ARE COOLED BY A DIRECTED FLUID FLOW PRODUCED BY TURBINES INSIDE THE ENGINE

[76] Inventor: Jacques Pellerin, 59 Bd de la République, 91450 Soisy-sur-Seine, France

[21] Appl. No.: 63,865

[22] Filed: Jun. 19, 1987

Related U.S. Application Data

[63] Continuation-in-part of Ser. No. 62,608, filed as PCT FR86/00434, Dec. 16, 1986, published as WO87/03929, Jul. 2, 1987.

[30] Foreign Application Priority Data

Dec. 19, 1985 [FR] France ..... 85 18826

[51] Int. Cl.[4] ..... F01P 3/02; F01P 3/08; F02B 75/26

[52] U.S. Cl. ..... 123/41.35; 123/41.79; 123/58 B

[58] Field of Search ..... 123/58 R, 58 B, 58 BA, 123/58 BB, 58 BC, 41.44, 41.35, 41.79

[56] References Cited

U.S. PATENT DOCUMENTS 2,099,983 11/1937 Lake ..... 123/58 R
2,403,282 7/1946 Holmes ..... 123/58 BB

FOREIGN PATENT DOCUMENTS 625854 9/1961 Italy ..... 123/58 BA

*Primary Examiner*—Tony M. Argenbright
*Attorney, Agent, or Firm*—Young & Thompson

[57] ABSTRACT

A barrel machine, more particularly a barrel engine cooled by means of turbines (5, 6) disposed around a central shaft (4) and distributing the outside air from the central part of the engine, more particularly inside the pistons and liners. Water and oil can therefore be eliminated, more particularly if an aerosol is used as coolant.

16 Claims, 2 Drawing Sheets

BARREL HEAT ENGINE WHOSE PISTONS AND LINERS ARE COOLED BY A DIRECTED FLUID FLOW PRODUCED BY TURBINES INSIDE THE ENGINE

This is a continuation-in-part of my copending application Ser. No. 062,608 filed as PCT FR86/00434, Dec. 16, 1986, published as WO87/03929, Jul. 2, 1987.

Cooling the compression chamber walls of heat engines is of vital importance and is also of interest in positive displacement compressors where the temperature rise of the cylinder walls may sometimes raise problems.

The problem has been solved until now solely by cooling the outer cylinder walls by a flow of water or air. In some very large heat engines, the piston heads are moreover sprayed by a complicated mechanism.

According to one object of the invention, there is provided in a machine—such an engine or a pump—using a barrel movement convecter, opposite the movement output or input shaft, a shaft carrying turbines adapted to intake a coolant fluid such as external air (or a liquid) and deliver it through appropriate ducts into the cylinder bores adjacent that face of the pistons which is remote from the working chambers, before removing said coolant fluid with or without using the pressure thereof to facilitate the intake of the fuel mixture.

According to another object of the invention, the machine can be broken into four elements, i.e. a movement conversion element including the movement convecter, a thermal separation element from which coolant fluid is pumped into the cylinder bores, a compression element defining the cylinders bores and a head block element comprising distribution devices.

According to another object of the invention, there is provided a machine comprising parallel cylinder bores disposed in barrel, pistons reciprocable in said cylinder bores and defining in said bores working chambers adjacent one face of said pistons, rods connecting said pistons with a movement converter connected to a rotatable shaft extending generally parallel to axes of the cylinder bores and adapted to provide movement transformation between reciprocations of said rods and rotation of said rotatable shaft, and valving means, wherein the machine is provided with internal means defining at least one path for a coolant fluid, said path including in said cylinder bores, cooling chambers which are separated from the working chambers by said pistons, and with at least one coolant fluid-propelling means driven by said shatf.

Preferably, said coolant fluid-propelling means is a turbine, and said turbine is mounted in a thermal separation compartment located between a movement converter compartment and a cylinder assembly.

Still preferably, the pistons are rigidly connected to first rods slidably extending through the thermal separation compartment, and wherein connecting rods articulated at both ends extend between said first rods and the movement converter. Said first rods are slidably guided in a slide bearing of a wall separating the movement conversion compartment and the thermal separation compartment.

The working cycle used for engines of some size is nearly always the 4-stroke cycle in which there is only one power reciprocation of the piston for every two reciprocations it makes; the invention is based on the idea of using this advantageous element to cool the cylinder liners and pistons which receive in the cooling chambers an equivalent air flow which is at least twice the flow of the hot gases produced by the explosion. The system with the first rods and connecting rods would be impracticable with the conventional movement converter using a connecting rod and crank assembly, for the use of rodded pistons as required by the device just described leads to a prohibitive increase in the inertia of the moving parts, a disadvantage not found in machines using a movement conversion of the barrel type. The system with the first rod extending through the thermal separation compartment and the articulated connecting rod is advantageous because it allows more efficient guiding of the pistons and protection of the movement converter from heat and pollution.

If needed, a second coolant fluid path may be provided adjacent an outer surface of liners defining the cylinder bores, and a second coolant fluid-propelling means, driven by said shaft, may propell coolant fluid along said second path.

Said second coolant fluid-propellling means may be a turbine. Said second coolant fluid path may be a derivation of said one path, said derivation beginning downstream of said one coolant fluid-propelling means.

The machine may comprise four compartments which are successive along an axis of the machine, said axis being parallel to the axes of the cylinders bores, said compartments being a movement conversion compartment including the movement converter, a thermal serparation compartment including the coolant fluid-propelling means, a cylinder assembly compartment in which the cylinder bores are provided, and a head block assembly.

Preferably, the machine comprises four successive plates between which the movement conversion compartment, the thermal separation compartment and the cylinder assembly compartment are defined, distance pieces between said plates, and means for tightening towards each other the head block assembly, the plates and the distance pieces along a direction parallel to the axes of the cylinder bores.

Said distance pieces are preferably distance pipes through which the tightening means extend.

Other features and advantages of the invention will become apparent in the following non limitative description.

Figure 1:
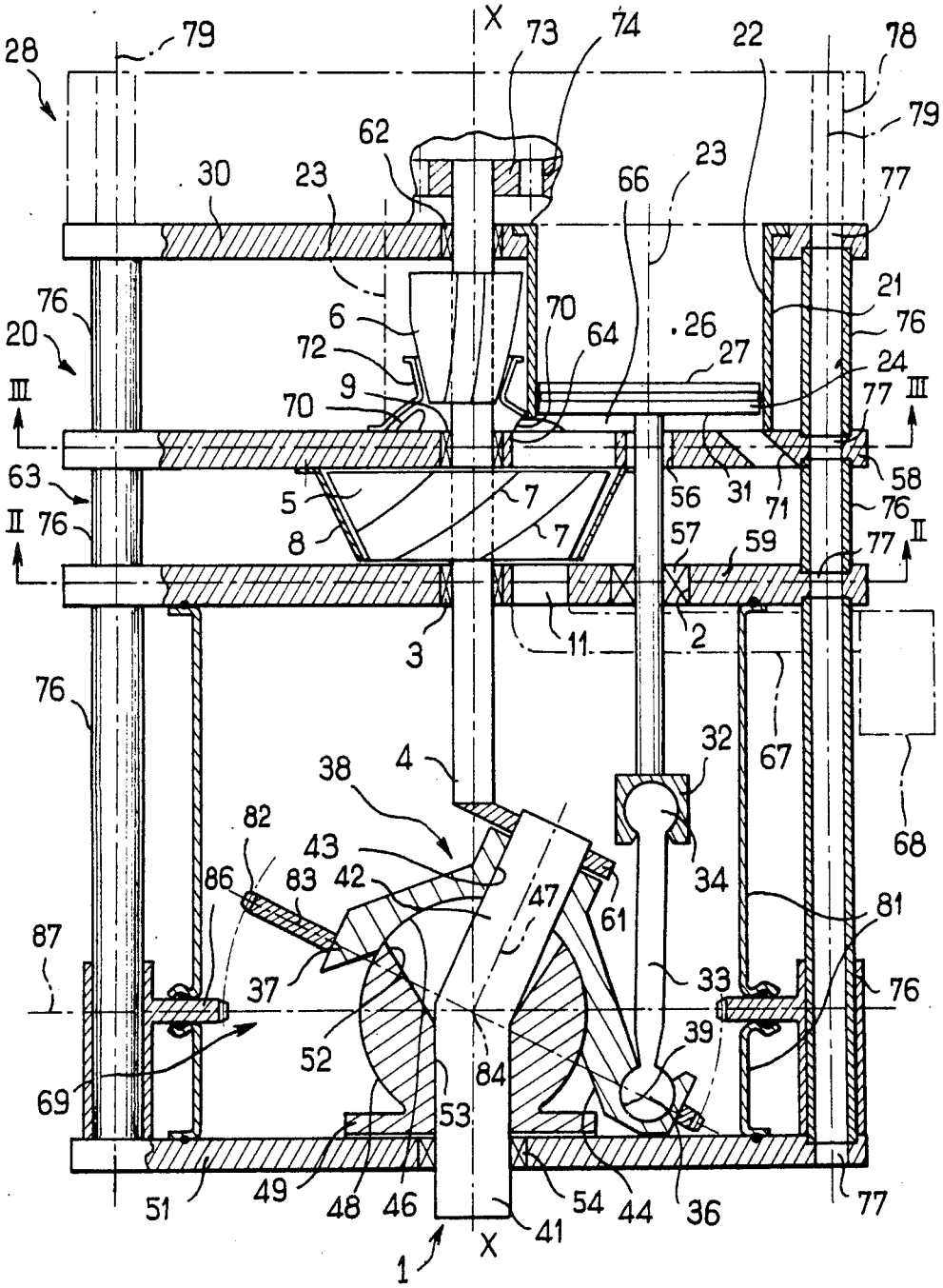
FIG. 1 is a diagrammatic sectional view of an engine according to the invention, wherein for sake of clarity, only one liner-piston assembly has been shown, with its piston at its lower end position.
Figure 2:
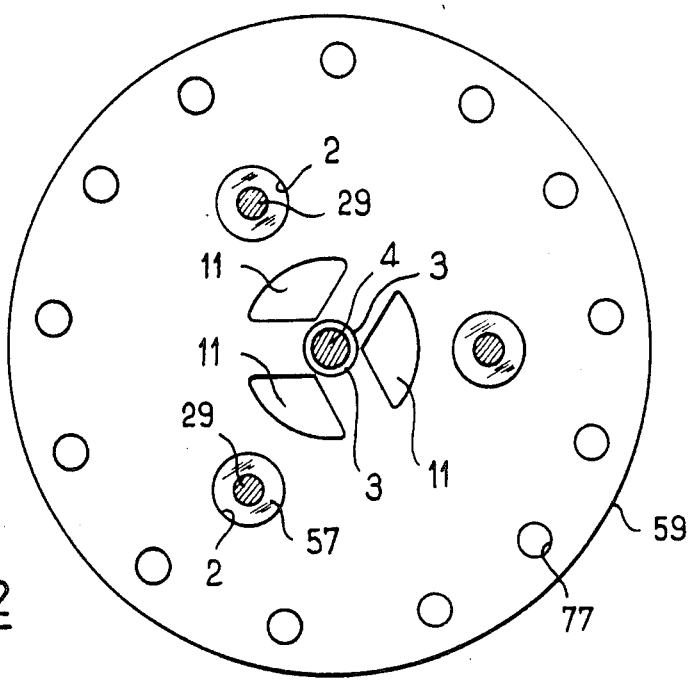
FIG. 2 is a sectional view along line II—II of FIG. 1.
Figure 3:
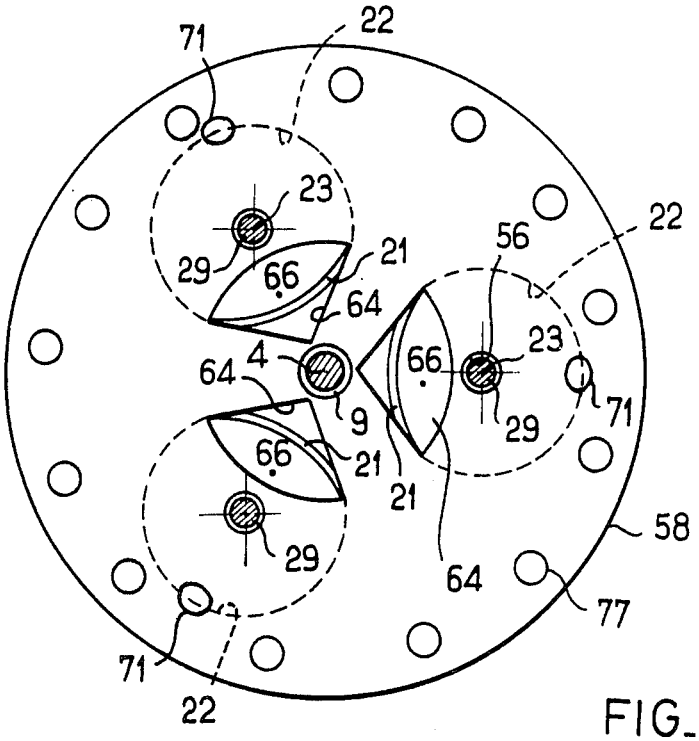
FIG. 3 is a sectional view along line III—III of FIG. 1.

As shown in FIG. 1, the engine comprises a cylinder assembly 20 in which a plurality of liners 21 define cylinder bores 22 having axes 23 disposed parallel to each other and parallel to a central axis XX of the machine. As apparent from FIG. 3 the axes 23 of the cylinder bores 22 (three bores in the example) are disposed at equal angles between eachother about the axis XX, according to the barrel arrangement.

In each cylinder bore 22, there is sealingly and reciprocably mounted a piston 24. A working chamber 26 is defined in each bore 22 adjacent a first face 27 of piston 24 and a head block 28 (shown in dotted lines) performing valving functions so as to selectively close working chamber 26 or connect it with exhaust pipe(s) and intake pipe(s) along the working cycle of the machine.

Head-block 28 rests on a plate 30 which is provided with circular holes in which liners 21 are secured.

An axial rod 29 is rigidly connected to a center area of a second face 31 of each piston 24, said second face being opposed to face 27 and remote from working chamber 26.

Remote from piston 24, rod 29 is terminated by a concave ball joint element 32. A connecting rod 33, having a convex ball joint element 34, 36 at each end, is interposed between rod 29 and a cap 37 of a barrel-type movement converter generally denoted by 38.

Cap 37 has three spherical recesses 39 which are each positioned in the vicinity of a respective one of the axes 23. The ball joint elements 34, 36 of each connecting rod 33 are respectively accomodated in the ball joint element 32 of a rod 29 and the corresponding spherical recess 39 of cap 37.

The machine has an input/output shaft 1 (input 1 the case of a pump, output in the case of an engine) which has an external portion 41 which is coaxial with XX, and a movement converting portion 42 which is bent at an angle with respect to external portion 41. Shaft 1 is rotatable about axis XX. Portion 42 is rotatably and slidably mounted in a center through-bore 43 of cap 37. The recesses 39 of cap 37 are angularly equally spaced from eachother about through bore 43.

Cap 37 has a face 44 facing towards external shaft portion 41 and away from pistons 24, rods 29 and connecting rods 31. Face 44 is provided with a spherical recess 46 having its center on the axis 47 of shaft portion 42.

Recess 46 is slidably resting on a ball 48 having the same radius as recess 46. Ball 48 has, remote from recess 46, a base 49 secured to a plate 51 of the machine. Ball 48 has a through bore having, adjacent recess 46, a conical portion 52 in which shaft portion 42 has place enough for its orbital movement whereas the opening of portion 49 is sufficiently smaller than recess 46 for ensuring that recess 46 bears on ball 48 all around said opening in any angular position of shaft 1. The conical bore portion 52 tapers in a direction away from recess 46, and, at its end remote from recess 46, is connected to a cylindrical bore portion 53 in which shaft portion 41 is rotatably mounted. The axis of bore portions 52 and 53 is XX, thus, the center of ball 48 is on axis XX. Shaft portion 41 extends through a hole through plate 51 and is supported therein by a bearing 54.

Cap 37 is integral with a surrounding gear 82, the center plane 83 of which extends through the center 84 of ball 48 and the center of reach recess 39. Gear 82 is meshing in two diametrically opposed positions with an internal gear 86 having the same diameter and the same center point as gear 82, said center point being center 84 of ball 48.

Gear 86 is rigidly connected to stationary parts of the machine, such as plate 51 and its center plane 87 is normal to axis XX. Thus, when the pistons 27 reciprocate, cap 37 oscillates but is prevented from rotating by the so-called torque retaining means provided by gears 82 and 86 meshing together, so that axis 47 follows an ideal cone while shaft 1 rotates. The movement conversion mechanism 38 is reversible, i.e. is able to convert rotation of shaft 1 into reciprocation of pistons 24, as well as reciprocation of pistons 24 into rotation of shaft 1.

Each rod 29 extends through holes 56 and 2 provided in two superposed plates 58 and 59 respectively. In plate 58, which is adjacent the cylinder liners 21 at an end thereof remote from plate 30, there is a clearance all around each rod 29, between said rod and the corresponding hole 56. In plate 59, which is adjacent movement converter 38, a slide bearing 57 is provided in each hole 2 for the corresponding rod 29. This, each piston 24—rod 29 assembly is slidably guided for reciprocation along axis 23 by a bore 22 and a slide bearing 57. This allows a surprisingly short axial extent of pistons 24.

Shaft portion 42 projects through cap 37 towards plate 59 and, beyond cap 37, is rigidly connected to a crank 61 which in turn is rigidly connected to a secondary shaft 4 extending along axis XX through the machine up to head block 28, through bearings 3, 9 and 62 provided in central through holes of plates 59, 58 and 30 respectively.

The compartment 63 between plates 58 and 59 is a thermal separation means which thermally separates the hot cylinder assembly from the movement converter 38 and ball joints 32–34 and 36–39, which form altogether a movement conversion assembly.

Secondary shaft 4 carries in the thermal separation compartment 63 a turbine 5 which is surrounded by a fluid guiding casing 81 secured to one of the plates 58, 59. Turbine 5, which is of the axially displacing type, is adapted to intake coolant fluid through apertures 11 provided through plates 59 and to expell said coolant fluid through apertures 64 provided through plate 58.

The apertures 64 respectively register with the lower open ends of liners 21, into a cooling chamber 66 which in each bore 22 is separated from the working chamber 26 by the corresponding piston 24.

Thus, there is provided in the machine a coolant fluid path comprising in this order along the direction of flow: apertures 11, the ducts between vanes 7 of turbine 5, apertures 64, cooling chambers 66 in bores 22.

Upstream of this, the path comprises for each aperture 11 a hose 67, for example a flexible hose connected to a coolant fluid source 68. Fluid source 68 is preferably a means of forming an air-water aerosol, i.e. droplets of water in a flow of air. The very fine water droplets will provide improved cooling and some lubrication. The coolant fluid may also be air, and in this case, the hoses 67 directly intake air outside a casing 81 laterally surrounding the movement conversion compartment 69.

Downstream of the cooling chambers 66, the coolant fluid path comprises ports 71, each said port 71 being provided through plate 58 between a respective cooling chamber 66 and the thermal separation compartment which outside casing 8 is laterally open to atmosphere.

In an engine, and if the coolant fluid is an air-water aerosol, it is also possible that the exhausting coolant fluid be sent to the engine intake where air of some temperature and pressure and containing water droplets may be useful for improving the efficiency in place of air originating directly from the atmosphere.

Between plates 58 and 30, secondary shaft 4 carries a second turbine 6 which is rotatable between the liners 21. Turbine 6 is operable for sucking coolant fluid through a surrounding tubular casing 72 secured to plate 58 in compartment 20 and having intake ports 70 communicating with the apertures 64, and for centrifugating said coolant fluid towards the liners 21 and, therebeyond, towards the open air. Thus, there is created a second coolant fluid path which extends along the outer face of liners 21 and which is a derivation from the first coolant fluid path and originates downstream of turbine 5.

Beyond plate 30, secondary axis 4 carries a means 73 for actuating the valving means in the head block 28. Means 73 is shown as being a pinion adapted to actuate rotary valving means 74 of each cylinder, for example of the type shown in W0-87-01415 to the Applicant.

Plates 51, 59, 58, 30 are preferably plane and parallel to eachother, and normal to axes XX and 23. They are rigidly connected to eachother. To this end, rectilinear distance pipes 76 parallel to axis XX are regularly spaced around axis XX between the adjacent plates, i.e. 51–59, 59–58, and 58–30 respectively. The plates are formed with through holes 77 which are flush with the bores of the pipes and with a corresponding bore 78 throughout the head block 28. Tightening means, such as screws and bolts assemblies, denoted by dotted lines 79, extend parallel to axis XX throughout each set of aligned bores 78, holes 77 and pipes 76, so as to compressively tighten the whole assembly in the XX direction.

Although the thermal separation compartment and the cylinders compartment are preferably laterally open to air betweeen pipes 76, the movement conversion compartment is preferably surrounded by the sealed casing 81, so as to protect the ball-joint assemblies from dirt. Moreover, sealing means, not shown, are provided in bearings 2 and 3 for avoiding entry of hot and possibly dirty gas from thermal separation compartment 63. Bearing 54 or base 49 of ball 48 are also provided with sealing means.

The bores through which the central shaft extends are aligned very accurately with one another. To this end plates 30, 58, 59, 51 may be disposed above each other in a stack and machined together, especially as far as bores are concerned.

The use of new materials in the fields of friction and heat-insulation makes this solution even more attractive; the swiveling movement of the ball joints results in that sufficient lubrication can be provided by a grease which needs no renewal, and the completely linear movement of the piston and the reduction of friction caused by the heating thereof make it possible to suppress the oil circuit, particularly if the aerosol proposal hereinbefore set out is used, with a material such as Revetox.

In other words, oil and water are no longer necessary in an engine.

The advantages of such a construction are manifest:

A very considerable reduction in the number of parts, hence a reduction in weight;

Removal of unnecessary weight—oil, water with their corresponding equipment such as radiator, filter, ducting etc;

Reduction of friction, hence

Improved efficiency;

Reduced cost.

Turbine 6 may be omitted if the liners 21 are cooled enough from cooling chambers 66, or if part of the flow from turbine 5, guided into cylinder compartment 20 between the liners 21 through a device which could look like casing 72, has a sufficient rate for cooling liners 21 from outside without the aid of turbine 6.

The movement converter might be of a different type, for example of the known Z-shaft type.

Partitions may be provided in compartment 20 for directing fluid towards the surfaces to be cooled.

The coolant fluid may be liquid, e.g. liquid projected against piston face 31.

In head block 28, shaft 4 may drive any sort of valving means, including a conventional one with cams and depressable valves.

The pipes 67 may be rigid or flexible. If they are flexible, they may be moved so as to control the rate of coolant fluid flow.

I claim:

1. A machine comprising parallel cylinder bores disposed in barrel, pistons reciprocable in said cylinder bores and defining in said bores working chambers adjacent one face of said pistons, rods connecting said pistons with a movement converter connected to a rotatable shaft extending generally parallel to axes of the cylinder bores, said movement converter being adapted to provide movement transformation between reciprocations of said rods and rotation of said rotatable shaft, and valving means, wherein the machine is provided with internal means defining at least one path for a coolant fluid, said path including in said cylinder bores cooling chambers which are separated from the working chambers by said pistons, and with at least one coolant-fluid-propelling turbine driven by said shaft and mounted in a thermal separation compartment located between a movement conversion compartment and a cylinder assembly.

2. A machine according to claim 1, wherein said path includes passages through a wall separating the movement conversion compartment from the thermal separation compartment, and passages by which the thermal separation compartment communicates with the cooling chambers of said cylinder bores.

3. A machine according to claim 1, wherein the pistons are rigidly connected to first rods slidably extending through the thermal separation compartment, and wherein connecting rods articulated at both ends extend between said first rods and the movement converter.

4. A machine according to claim 3, wherein said first rods are slidably guided in a slide bearing of a wall separating the movement conversion compartment and the thermal separation compartment.

5. A machine according to claim 1, said machine being an engine, wherein said rotatable shaft comprises an output shaft and a secondary shaft connected to said output shaft and extending from the movement converter towards the cylinder assembly, said secondary shaft carrying the turbine.

6. A machine according to claim 1, said machine being a pump, wherein said rotatable shaft comprises an input shaft and a secondary shaft connected to said input shaft and extending from the movement converter towards the cylinder assembly, said secondary shaft carrying the driving means.

7. A machine comprising parallel cylinder bores disposed in barrel, pistons reciprocable in said cylinder bores and defining in said bores working chambers adjacent one face of said pistons, rods connecting said pistons with a movement converter connected to a rotatable shaft extending generally parallel to axes of the cylinder bores, said movement converter being adapted to provide movement transformation between reciprocations of said rods and rotation of said rotatable shaft, and valving means, wherein the machine is provided with internal means defining a first and a second path for a coolant fluid, said first path including in said cylinder bores cooling chambers which are separated from the working chambers by said pistons, said second path being adjacent an outer surface of liners defining the cylinder bores, and with at least one coolant-fluid-propelling means driven by said shaft.

8. A machine according to claim 7, with a second coolant-propelling means, driven by said shaft, for propelling coolant fluid along said second path.

9. A machine according to claim 8, wherein said second coolant-fluid-propelling means is a turbine.

10. A machine according to claim 7, wherein said second coolant fluid path is a derivation of said one path, said derivation beginning downstream of said one coolant-fluid-propelling means.

11. A machine comprising parallel cylinder bores disposed in barrel, pistons reciprocable in said cylinder bores and defining in said bores working chambers adjacent one face of said pistons, rods connecting said pistons with a movement converter connected to a rotatable shaft extending generally parallel to axes of the cylinder bores, said movement converter being adapted to provide movement transformation between reciprocations of said rods and rotation of said rotatable shaft, and valving means, wherein the machine comprises means for producing an aerosol for use as a coolant fluid, internal means defining at least one path for said coolant fluid, said path including in said cylinder bores cooling chambers which are separated from the working chambers by said pistons, and with at least a coolant-fluid-propelling means driven by said shaft.

12. A machine according to claim 11, wherein said means for producing an aerosol are means for producing an air-water aerosol.

13. A machine comprising parallel cylinder bores disposed in barrel, pistons reciprocable in said cylinder bores and defining in said bores working chambers adjacent one face of said pistons, rods connecting said pistons with a movement converter connected to a rotatable shaft extending generally parallel to axes of the cylinder bores, said movement converter being adapted to provide movement transformation between reciprocations of said rods and rotation of said rotatable shaft, and valving means, wherein the machine is provided with internal means defining at least one path for one coolant fluid, said path including in said cylinder bores cooling chambers which are separated from the working chambers by said pistons, and with at least one coolant-fluid-propelling means driven by said shaft, and wherein said rotatable shaft comprises a secondary shaft extending from said movement converter towards a head block of the machine, said secondary shaft driving valving means at an end remote from the movement converter, and driving the coolant-fluid-propelling means at a position intermediate the movement converter and said end remote from the movement converter.

14. A machine comprising parallel cylinder bores disposed in barrel, pistons reciprocable in said cylinder bores and defining in said bores working chambers adjacent one face of said pistons, rods connecting said pistons with a movement converer connected to a rotatable shaft extending generally parallel to axes of the cylinder bores, said movement converter being adapted to provide movement transformation between reciprocations of said rods and rotation of said rotatable shaft, and valving means, wherein the machine is provided with internal means defining at least one path for one coolant fluid, said path including in said cylinder bores cooling chambers which are separated from the working chambers by said pistons, and with at least a coolant-fluid-propelling means driven by said shaft, said machine comprising four compartments which are successive along an axis of the machine, said axis being parallel to the axes of the cylinder bores, said compartments being a movement conversion compartment including the movement converter, a thermal separation compartment including the coolant-fluid-propelling means, a cylinder assembly compartment in which the cylinder bores are provided, and a head block assembly.

15. A machine according to claim 14, comprising four successive plates between which the movement conversion compartment, the thermal separation compartment and the cylinder assembly compartment are defined, and between which distance pieces are provided, and means for tightening towards eachother the head block assembly, the plates and the distance pieces along a direction parallel to the axes of the cylinder bores.

16. A machine according to claim 15, wherein the distance pieces are distance pipes through which the tightening means extend.

* * * * *